US006422790B1

(12) United States Patent
Damron

(10) Patent No.: US 6,422,790 B1
(45) Date of Patent: Jul. 23, 2002

(54) FOAM BLOCKS FOR CONSTRUCTION OF MINE TUNNEL STOPPINGS

(76) Inventor: Danny Ray Damron, 274 Lick Fork, Pikeville, KY (US) 41501

( * ) Notice: Subject to any disclaimer, the term of this patent is extended or adjusted under 35 U.S.C. 154(b) by 0 days.

(21) Appl. No.: 09/795,960

(22) Filed: Feb. 28, 2001

Related U.S. Application Data

(60) Provisional application No. 60/186,846, filed on Mar. 3, 2000.

(51) Int. Cl.[7] ..... F21D 11/00

(52) U.S. Cl. ..... 405/150.1; 405/303; 405/288; 454/168; 454/169; 299/12

(58) Field of Search ..... 299/12; 405/303, 405/288, 150.1; 454/168, 169

(56) References Cited

U.S. PATENT DOCUMENTS 3,755,211 A * 8/1973 Fabris et al. ..... 521/137
3,782,049 A * 1/1974 Sachs
3,933,514 A * 1/1976 Banks et al.
4,314,036 A * 2/1982 Throne et al.
4,475,326 A * 10/1984 Hanson
4,516,879 A 5/1985 Berry ..... 405/132
4,711,912 A * 12/1987 Snider et al. ..... 521/125
5,457,926 A * 10/1995 Jensen
5,596,853 A * 1/1997 Blaney et al.
5,617,686 A * 4/1997 Gallagher, Jr.
5,934,990 A * 8/1999 Steffenino et al.
6,056,638 A 5/2000 Jones ..... 454/169
6,082,828 A 7/2000 Bailey ..... 299/12

FOREIGN PATENT DOCUMENTS

DE 19714626 A1 * 10/1997
DE 29919667 U1 * 2/2000

OTHER PUBLICATIONS

Masterseal® 800 brochure from www.uge.mbt.com/ventilation.htm website teahes a polymeric mine stopping coating spray.*

ABC Industries "The History of American Brattice Cloth" brochure discloses a short history of Brattice Cloths, from the the website www.geocities.com/Heartland/Plains/3331/abchist.html.*

* cited by examiner

*Primary Examiner*—David Bagnell
*Assistant Examiner*—Katherine Mitchell

(57) ABSTRACT

A light weight foam block being substantially rectangular in shape, having horizontal and/or vertical pairs of tongues and grooves around its perimeter enabling it to interlock with horizontally and/or vertically adjacent blocks to construct a mine stopping wall.

20 Claims, 3 Drawing Sheets

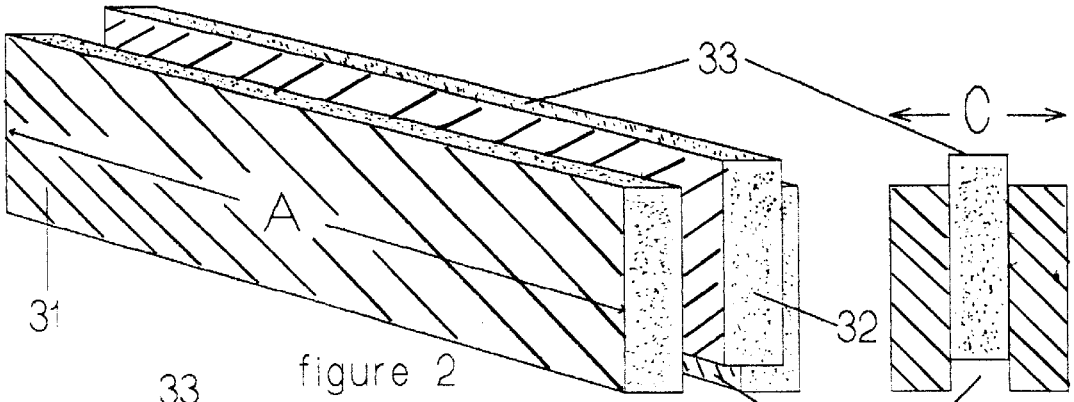
figure 2
figure 6
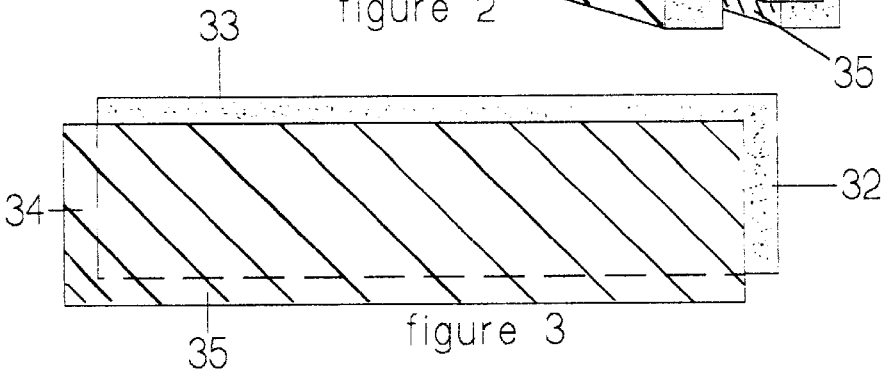
figure 3
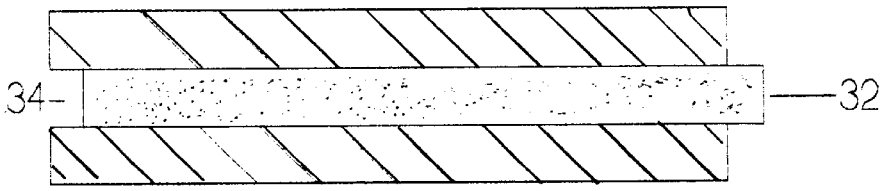
figure 4
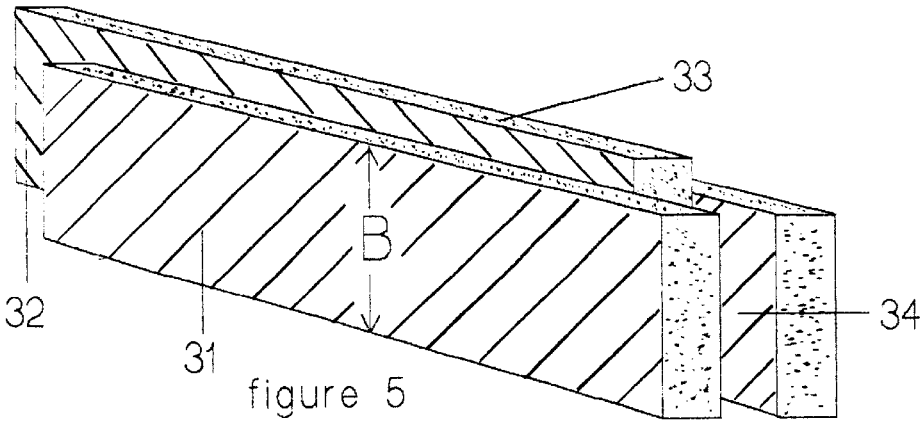
figure 5

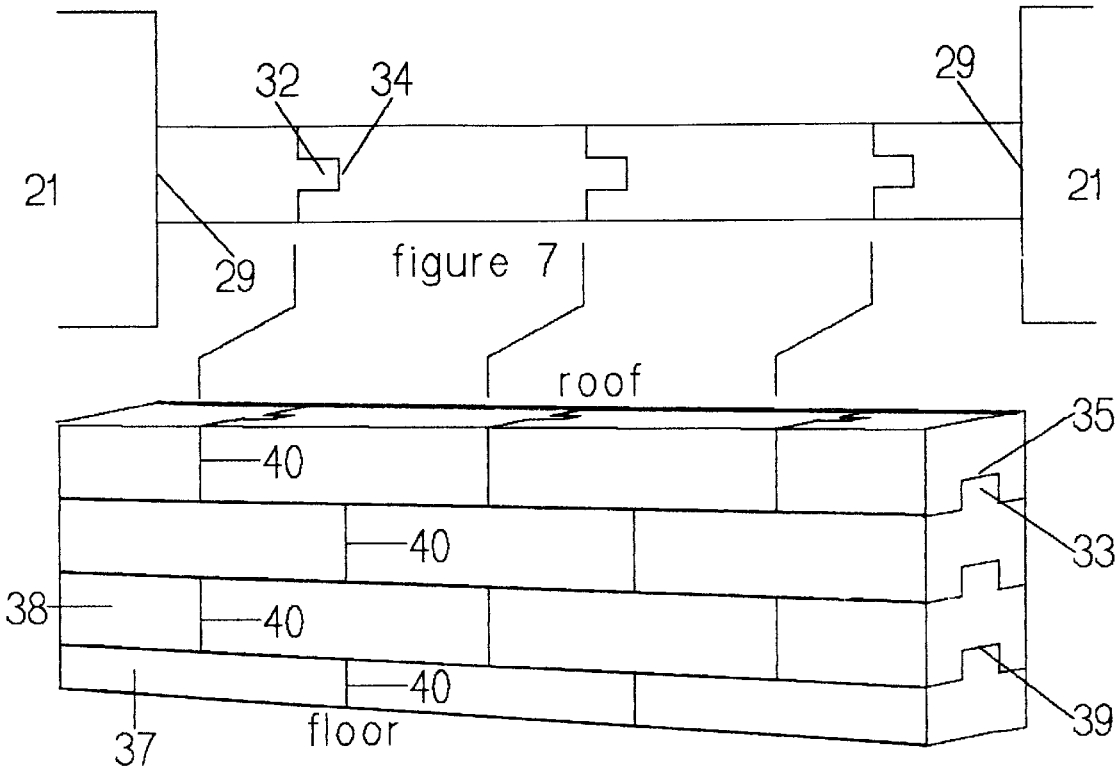
figure 7
figure 8
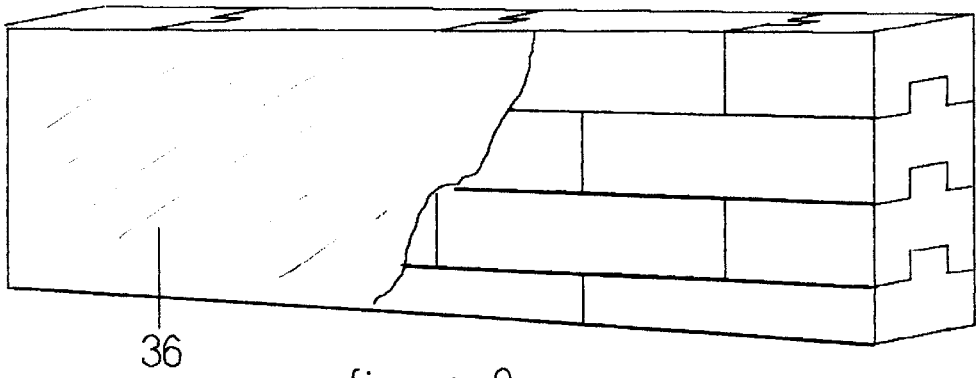
figure 9

FOAM BLOCKS FOR CONSTRUCTION OF MINE TUNNEL STOPPINGS

CROSS REFERENCE TO RELATED APPLICATIONS

This application claims the benefit of Provisional Patent Application Ser. No. 60/186,846 filed Mar. 3, 2000.

BACKGROUND

1. Field of Invention

This invention relates to the construction of ventilation control devices or "stoppings" used in mine tunnels. The preferred mine stopping of this invention is constructed of blocks made from a light weight foaming material such as but not limited to polyurethane foam and have a tongue and groove configuration.

2. Description of Prior Art

Stopping devices are used to control and direct the flow of fresh air throughout mine tunnels and more especially the working face. Conventional stopping consists of walls constructed of concrete block. These walls are difficult to construct and very labor intensive. For example one stopping could use 160 blocks weighing 40 lbs each. This means 6400 lbs of blocks would have to be loaded on a mining car on the outside of the mine. This load would then be transported inside the mine, often a number of miles, to the end of the track nearest the stopping construction site. At this point this 6400 lb load of blocks most likely will have to be manually loaded from the car. If a scoop or other piece of equipment is readily available they can be loaded directly into it and hauled to the construction site. If haulage equipment is not available these blocks will have to be manually unloaded to the ground and later manually loaded onto haulage equipment and hauled to the construction site. Once on the construction site these blocks will be unloaded and stacked to make a stopping wall. This illustration shows that these very heavy blocks most likely will have to be handled 3 or 4 times from the outside of the construction site. Moreover in many areas of a mine, the portion of the mine tunnel to be stopped may be of a limited height and cross-sectional area, requiring a miner to carry heavy concrete blocks some distance in a crouched position or even on his hands and knees.

The rigidity of a mine stopping of this type make it susceptible to damage from heaving of the mine floor and sagging of the mine roof. This damage to the stopping will cause leakage and will have to be repaired or in some cases totally rebuilt. Prior arts attempt to overcome some of these burdens associated with concrete block mine stoppings have included the use of polyurethane filled bags to Bailey U.S. Pat. No. 6,008,282, polyurethane sheets by Jones U.S. Pat. No. 6,056,638 and the use of a matrix material coated with a sealant by Steffenino U.S. Pat. No. 5,934,990. Each of these have had little or no practical success.

Therefore it is evident that there is a great need for an improved mine stopping, one that is easily transported, can be readily constructed, even in difficult locations, and handle convergent loads. This invention addresses these needs.

SUMMARY INCLUDING OBJECTS AND ADVANTAGES

The blocks of this invention are made of a light weight foaming material such as but not limited to polyurethane foam and have a tongue and groove configuration. The top of the block has a tongue and the bottom has a groove. One end of the block has a tongue and the other has the groove. As the bottom row is placed the tongue on the end of the first block inserts into the groove of the next block. Subsequent blocks are placed in like manner, with tongues engaging grooves, across the opening to be stopped. A second row of blocks will be placed on top of the first assuring that the blocks and joints are staggered. The groove on the bottom of this row of blocks will accept the tongue of the blocks of the first row. Subsequent rows are done in a like manner until the stopping wall is complete.

OBJECTS OF ADVANTAGES

Accordingly, several objects and advantages of my invention are:

1. Provide an improved mine stopping that will permit effective ventilation of the mine face.
2. Provide an improved mine stopping that will withstand convergence of the mine floor and roof without falling thereby extending the life of the stopping.
3. Provide and improved mine stopping which can be more quickly and easily be installed.
4. Provide an improved mine stopping that will weight less therefore making it easier transported.
5. Provide a mine stopping block that can be re-used.

Still further objects and advantages will become apparent from a consideration of the ensuing description and accompanying drawings.

BRIEF DESCRIPTION OF THE DRAWINGS

FIG. 2 is an overall view showing tongue end of block.

FIG. 3 is a side view of FIG. 2.

FIG. 4 is a top view of FIG. 2.

FIG. 5 is an overall view showing groove end of block.

FIG. 6 is an end view of block.

FIG. 7 is top view of a row of blocks placed end to end showing tongues and grooves engaged and stopping wall placement between mine pillars.

FIG. 8 is an overall view of a topping wall constructed by using a plurality of blocks. Exposed end of wall also shows tongues and grooves of the top and bottom of blocks engaged.

FIG. 9 is a view of the stopping wall with a sealant being applied.

Reference Numerals

Figure 1:
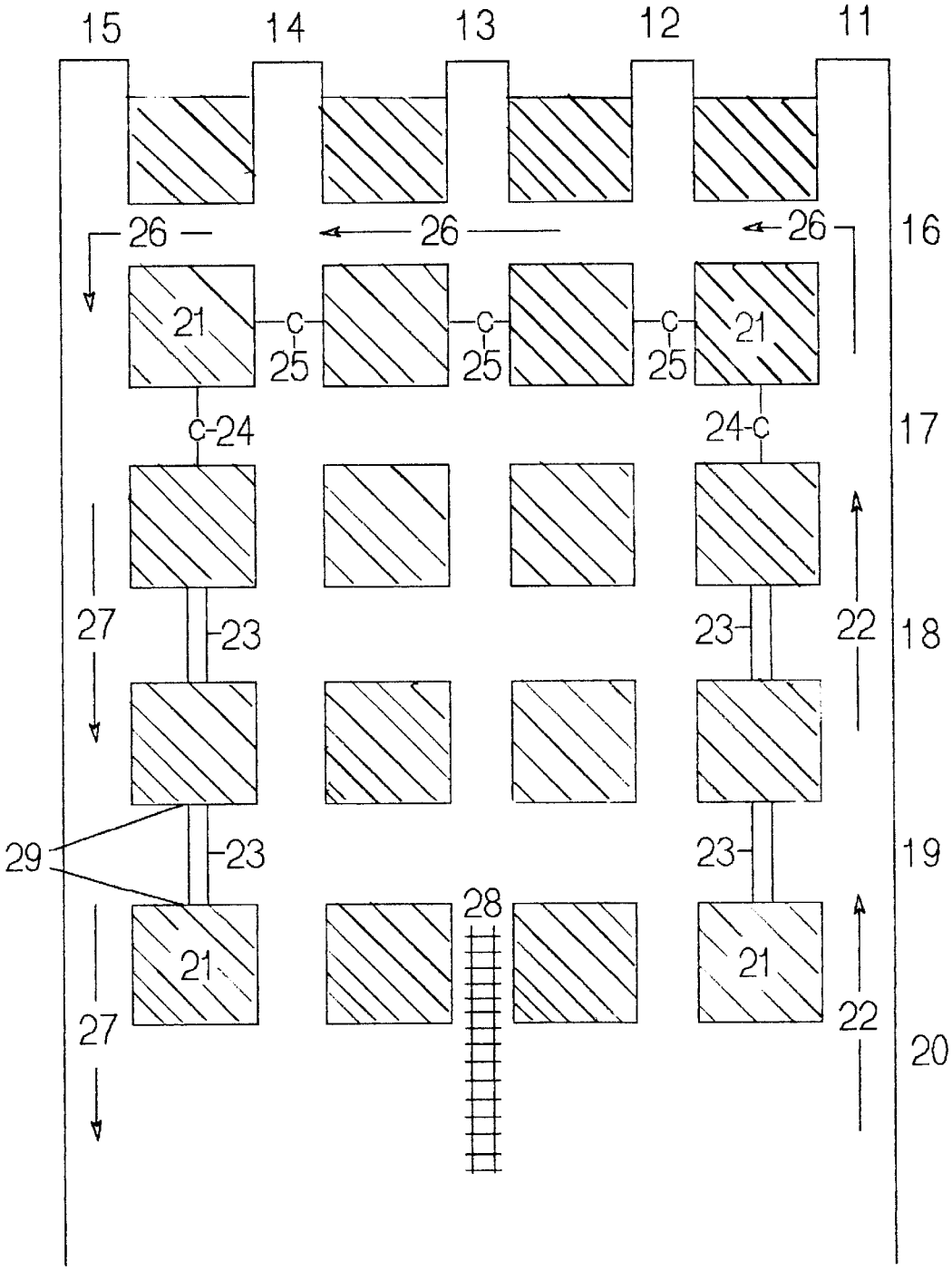
FIG. 1 is a schematic diagram of a room and pillar mine.

11 Mine tunnel column or "heading"
12 Mine tunnel column or "heading"
13 Mine tunnel column or "heading"
14 Mine tunnel column or "heading"
15 Mine tunnel column or "heading"
16 Mine tunnel row or "crosscut"
17 Mine tunnel row "crosscut"
18 Mine tunnel row or "crosscut"
19 Mine tunnel row or "crosscut"
20 Mine tunnel row or "crosscut"
21 Pillars
22 Intake air
23 Stopping
24 Line curtain
25 Cross curtain
26 Air across working face
27 Return air
28 End of supply track

29 Pillar walls
31 Block
32 Tongue on end of block
33 Tongue on top of block
34 Groove on end of block
35 Groove on bottom of block
36 Sealant
37 First block to be laid
38 First block of second row
39 Tongue and grooves of first row
40 Joints at ends of block

PREFERRED EMBODIMENT—DESCRIPTION

In describing this embodiment of the invention specific terminology and dimensions will be used for the sake of clarity and comparison to prior art. However, the invention is not intended to be limited to these specific terms or dimensions, and it is to be understood that each specific term includes all technical equivalents which operate in a similar manner to accomplish a similar purpose.

To facilitate understanding of the environment in which mine stoppings are used, and air flow patterns are created, it is believed the following discussion of FIG. 1 will be helpful.

In FIG. 1 a plurality of mine tunnels or "headings" are represented by numbers 11-12-13-14-15. The area of these numbers 11 through 15 will constitute the working face of the mine. Extending perpendicular to and intersecting columns 11 thru 15 are tunnels represented by 16-17-18-19-20. These rows are generally referred to as "crosscuts". These columns and rows together form a plurality of Pillars 21. As shown by arrows 22 intake air is introduced into the number 11 column and is kept in number 11 by permanent 23 and temporary line curtain 24. The air 26 is guided across the working face by temporary cross curtains 25. Here it picks up explosive gases and dust then exits by way of column or heading number 15. This gaseous laden air 27 is kept in heading 15 by line curtain 24 and stoppings 23. Line curtain 24 are temporary devices used to control the flow of air close by the working face permitting workers and equipment to pass thru freely. As the mine advances the next crosscut will be completed opening up another row. When this happens cross curtain 25 will be moved up to the next row of pillars. Line curtain 24 will be moved up to row 16 and permanent stoppings 23 will replace line curtain 24. This cycle keeps the integrity of the ventilation system.

Another point that can be seen in FIG. 1 is the distance from the end of the track 28 to the construction site of line stoppings 24 as discussed in prior art.

Stoppings must provide the equivalent critical properties to that of concrete blocks as defined by 30 cfr. part 75,333 with respect to durability, noncombustibility and surface flammability.

1-One hour fire resistance as described in astm 119-88

2-Traverse load strength as described in astm E72-80

3-Flame spread index of less than 25 as described in astm E 162.

The following description of the block of this invention will be referred to FIGS. 2 thru 6. The block of this invention could be 8 feet long FIG. 2-A. 18 inches in height FIG. 5-B, and 6 inches in depth FIG. 6-C. The weight of this block could be as little as 10 pounds. This one block could replace 13.5 concreted blocks that weigh a combined weight of 540 pounds. This block will be made of a lightweight foaming material such as but not limited to polyurethane foam. Said block will have a tongue on top 33 and a groove on bottom 35. One end of block will have a tongue 32 and the opposing end will have a groove 34. This configuration allows each block of a stopping wall to inter-connect with all adjacent blocks both vertically and horizontally.

PREFERRED EMBODIMENT—OPERATION

A plurality of these blocks will be used to construct a stopping wall FIG. 8. The stopping wall is constructed in the following manner. The first block 37 of the bottom row is placed against the pillar wall 29. The remaining blocks of this row are placed end to end with tongues engaging grooves 32 & 34 across the opening of the opposite pillar wall. FIG. 7 is a top view of a row of blocks showing tongues and grooves connecting. The second row is started by placing ½ block 38 against pillar wall and on top of block 37. The bottom groove 35 in the blocks of the second row engage the tongue 33 of the blocks of the first row. By starting the second row with ½ block insures the vertical joints 40 will be staggered. The second row is completed in the same manner as bottom row. The remaining rows are done in the same manner until the wall reaches the roof of the room. Upon completion the stopping is coated with a fireproof sealant 36 on both sides. This sealant will also be used to seal any gaps around the perimeter of the stopping and bind the stopping wall to the walls, roof, and floor. Sandvik MTA, SMS< or Crisco Rediseal are only 3 of the many sealants that may be used.

CONCLUSIONS, RAMIFICATIONS, AND SCOPE

Accordingly, it can be seen that the present invention provides a light weight block that is easily transported and assembled to construct a stopping wall that will withstand convergent loads without failure and permit effective ventilation to the mine face. Although the description above contains many specifications, these should not be constructed as limiting the scope of the invention but as merely providing illustrations of some of the presently preferred embodiments of this invention. Various other embodiments and ramifications are possible within its scope. For example, blocks of this invention could be cast in one piece or could be assembled by using a plurality of flat sheets. A stopping wall could be constructed with blocks in a vertical posture rather than the horizontal posture of the preferred embodiment. It is seen that variations and changes may be made by those skilled in the art without departure from the spirit of the invention.

Thus the scope of the invention should be determined by the appended claims and their legal equivalents, rather than by the examples given.

I claim:

1. A minestopping light weight foam block, of foamable plastic material with a density of approximately 1.67 lbs/ft3, being substantially rectangular in shape and having horizontal and vertical pairs of tongues and grooves around its perimeter that enable said block to interlock with horizontally and vertically adjacent blocks of the same design and material, for construction of mine stoppings, which are also known as mine stopping walls.

2. Block of claim 1 wherein the foam is polyurethane.

3. Block of claim 1 wherein the foam is polyisocyanurate.

4. Block of claim 1 wherein the foam is phenolic.

5. Block of claim 1 wherein stopping wall is coated by a fireproof coating.

6. Block of claim 1 wherein the foam is fire proof and does not need a coating.

7. Block of claim 1 wherein the foam is made fire proof by adding silicates.

8. Block of claim 1 placed with its longitudinal axis as the vertical dimension to construct a stopping wall.

9. Block of claim 1 wherein an adhesive is applied to tongues and grooves.

10. Block of claim 1 wherein the foam is reinforced by combining with reinforcements from the group consisting of glass fibers, matrix material, or an integral skin.

11. A minestopping light weight foam block, of foamable plastic material with a density of approximately 1.67 lbs/ft3, being substantially rectangular in shape and having horizontal or vertical pairs of tongues and grooves around its perimeter that enable said block to interlock with horizontally or vertically adjacent blocks of the same design and material, for construction of mine stoppings, which are also known as mine stopping walls.

12. Block of claim 11 wherein the foam is polyurethane.

13. Block of claim 11 wherein the foam is polyisocyanurate.

14. Block of claim 11 wherein the foam is phenolic.

15. Block of claim 11 wherein stopping wall is coated with a fireproof coating.

16. Block of claim 11 wherein the foam is fireproof and does not need a fireproof coating.

17. Block of claim 1 wherein foam is made fireproof by adding silicates.

18. Block of claim 11 wherein the foam is reinforced by combining with reinforcements from the group consisting of glass fibers, matrix materials, or an integral skin.

19. Block of claim 11 placed with its longitudinal axis as the vertical dimension to construct a stopping wall.

20. Block of claim 11 wherein an adhesive is applied to tongues and grooves.

* * * * *